US006088566A

United States Patent [19]

Todome

[11] Patent Number: 6,088,566

[45] Date of Patent: Jul. 11, 2000

[54] IMAGE FORMING APPARATUS FOR REGULATING THE ROLL UP OF A CONVEYOR

[75] Inventor: Tsuyoshi Todome, Kanagawa-ken, Japan

[73] Assignee: Kabushiki Kaisha Toshiba, Kawasaki, Japan

[21] Appl. No.: 09/231,551

[22] Filed: Jan. 15, 1999

[30] Foreign Application Priority Data

Jan. 16, 1998 [JP] Japan ..... 10-006504

[51] Int. Cl.[7] ..... G03G 15/00

[52] U.S. Cl. ..... 399/303; 399/165; 198/837

[58] Field of Search ..... 399/165, 299, 399/301, 303; 347/116; 198/840, 837

[56] References Cited

U.S. PATENT DOCUMENTS 5,316,524 5/1994 Wong et al. ..... 474/151
5,481,338 1/1996 Todome ..... 355/212
5,619,310 4/1997 Todome ..... 399/381
5,740,511 4/1998 Todome ..... 399/303

FOREIGN PATENT DOCUMENTS 62-147469 7/1987 Japan .
9-15990 1/1997 Japan .

*Primary Examiner*—Joan Pendegrass
*Attorney, Agent, or Firm*—Foley & Lardner

[57] ABSTRACT

An image forming apparatus according to the present invention is equipped with a conveyor belt that is arranged between a driving roller and a driven roller, and a regulating member that is arranged in parallel at the end of at least one of the driving roller and the driven roller. The regulating member includes a first regulation surface that makes the end edge of the conveyor belt contact and slide in horizontal direction when the conveyor belt runs and regulates the snaking of the conveyor belt, and a second regulation surface that protrudes from the first regulation surface so as to regulate the movement of the end edge of the conveyor belt in vertical direction.

9 Claims, 12 Drawing Sheets

IMAGE FORMING APPARATUS FOR REGULATING THE ROLL UP OF A CONVEYOR

BACKGROUND OF THE INVENTION

1. Field of the Invention

The present invention relates to an image forming apparatus that forms an image on an image receiving medium, for example, a color copier, monochrome copier and so on.

2. Description of Prior Art

In recent years, along with wide use of color documents in offices, color copiers have been widely put on markets. As one of these color copiers, there is a 4-drum tandem type. In this type, four photosensitive drums as image carriers are arranged in parallel, and toners of yellow, magenta, cyan, and black are used on the respective photosensitive drums to form toner images. These toner images are transferred one by one onto a sheet of image receiving medium that is carried on a conveyor belt, and thereby a color image is obtained.

In these color copiers, color displacement among four colors affects largely upon image quality. One of the causes for this color displacement is snaking of a conveyor belt.

To prevent this snaking of conveyor belt, a regulation plate is arranged in parallel with the conveyor belt at the end of front side of a driving roller of the conveyor belt. When the conveyor belt runs, the end edge thereof is slid on the plate surface (sliding surface) of the regulation plate and thereby guided.

However, in the conventional regulating method, the conveyor belt may run over the regulation plate. As countermeasures against the above, the area of the regulation plate is made wide, but when the area of the regulation plate is set wide, the area occupied by the regulation plate itself becomes large, as a result the copier itself becomes large, which has been a problem with the prior art.

And, when the lay force of the conveyor belt that slides on the regulation plate is large, the conveyor belt may temporarily twist up on the sliding surface with the regulation plate. If this twisting up status continues, bending fatigue occurs near the root of the twisting up of the conveyor belt and the conveyor belt is broken, which has been another problem with the prior art.

The problem of breakage of the conveyor belt owing to bending fatigue cannot be solved by merely making the regulation plate large.

As mentioned above, the conventional method by regulation plate has had the problem of the occupied area of the regulation plate and the problem of belt bending fatigue.

While, belt snaking amount is determined by the surface roughness of the sliding surface of the regulation plate, and the straightness of the end edge of the conveyor belt that slides on the sliding surface of the regulation plate. However, in the prior art, there has not been any standard as to how the surface roughness of the sliding surface of the regulation plate and the straightness of the end edge of the conveyor belt should be set.

And also the rigidity relation among the conveyor belt and the regulation plate and a supporting component that keeps the regulation plate has not been clearly specified.

Further, when lay force works large on the conveyor belt owing to external disturbance or so, total lay force works upon the regulation plate and the conveyor belt may be broken.

SUMMARY OF THE INVENTION

Accordingly, one object of the present invention is to provide an image forming apparatus that enables to prevent a conveyor means from rising upon a regulating means, and to prevent the conveyor means from bending in the regulating means, without making the size of the regulating means large.

Another object of the present invention is to provide an image forming apparatus wherein the surface roughness of the regulation surface of the regulating means and the straightness of the conveyor means that slides along the regulation surface are specified clearly.

Still another object of the present invention is to provide an image forming apparatus wherein the rigidity relation between the conveyor means and the regulating means are specified clearly.

And, further another object of the present invention is to provide an image forming apparatus wherein the conveyor means is not damaged even if lay force working on the conveyor means owing to external disturbance or so.

According to the present invention, it is possible to provide an image forming apparatus comprising plural image carriers arranged in parallel with each other at specified intervals; plural developed image forming means for forming developed images on the plural image carriers; conveyor means arranged between a driving roller and a driven roller and faces the plural image carriers for conveying an image receiving medium to the image carriers one after another; plural transfer means for transferring the developed images formed on the image carriers onto the image receiving medium that are conveyed by the conveyor means; and regulating means arranged in parallel at the end of at least one of the driving roller and the driven roller, the regulating means including a first regulation surface that makes the end edge of the conveyor means contact and slide in horizontal direction when the conveyor means runs and regulates the snaking of the conveyor means and a second regulation surface that protrudes from the first regulation surface so as to regulate the movement of the end edge of the conveyor means in vertical direction.

And, according to the present invention, it is possible to provide an image forming apparatus comprising plural image carriers arranged in parallel with each other at specified intervals; plural developed image forming means for forming developed images on the plural image carriers; conveyor means arranged between a driving roller and a driven roller and faces the plural image carriers for conveying an image receiving medium to the image carriers one after another; plural transfer means for transferring the developed images formed on the image carriers onto the image receiving medium that are conveyed by the conveyor means; and regulating means, that is arranged in parallel at the end of at least one of the driving roller and the driven roller and having a regulation surface, for regulating a snaking of the conveyor means by making the end edge of the conveyor means slide on the regulation surface when the conveyor means runs, the regulating means being characterized in that the regulation surface and the end edge of the conveyor means that slides on the regulation surface are positioned in the range ±50 $\mu$m in the direction crossing the regulation surface with the regulation surface as the center thereof.

Further, according to the present invention, it is possible to provide an image forming apparatus comprising plural image carriers arranged in parallel with each other at specified intervals; plural developed image forming means for forming developed images on the plural image carriers; conveyor means arranged between a driving roller and a driven roller and faces the plural image carriers for conveying an image receiving medium to the image carriers one after another; plural transfer means for transferring the developed images formed on the image carriers onto the image receiving medium that are conveyed by the conveyor means; and regulating means, that is arranged in parallel at the end of at least one of the driving roller and the driven roller and having a regulation surface, for regulating a snaking of the conveyor means by making the end edge of the conveyor means slide on the regulation surface when the conveyor means runs; wherein when a modulus of longitudinal elasticity of the regulating means in width direction of the conveyor means is set ES and a modulus of longitudinal elasticity in width direction of the conveyor means is set EB, there is a relation between the ES and the EB as shown below, $$ES>EB$$

and the ES is a material over 6,700 kg/mm$^2$.

And further, according to the present invention, it is possible to provide an image forming apparatus comprising plural image carriers arranged in parallel with each other at specified intervals plural developed image forming means for forming developed images on the plural image carriers; conveyor means arranged between a driving roller and a driven roller and faces the plural image carriers for conveying an image receiving medium to the image carriers one after another; plural transfer means for transferring the developed images formed on the image carriers onto the image receiving medium that are conveyed by the conveyor means; first regulating means that is arranged in parallel at the end surface of the driving roller and having a first regulation surface, for regulating a snaking of the conveyor means by making the end edge of the conveyor means slide on the regulation surface when the conveyor means runs; and second regulating means that is arranged in parallel at the end surface of the driven roller and positioned at outer side in width direction than the first regulation surface and having a second regulation surface, for regulating a snaking of the conveyor means by making the end edge of the conveyor means slide on the second regulation surface when the conveyor means run.

Other objects and advantages of the present invention will become apparent from the detailed description to follow in conjunction with the appended claims.

BRIEF DESCRIPTION OF THE DRAWINGS

FIG. 1 is a schematic diagram showing a color copier to which the present invention is applied to;

DETAILED DESCRIPTION OF THE PREFERRED EMBODIMENTS

A first preferred embodiment of the present invention is illustrated in more details by reference to FIG. 1 through FIG. 7.

Figure 1:
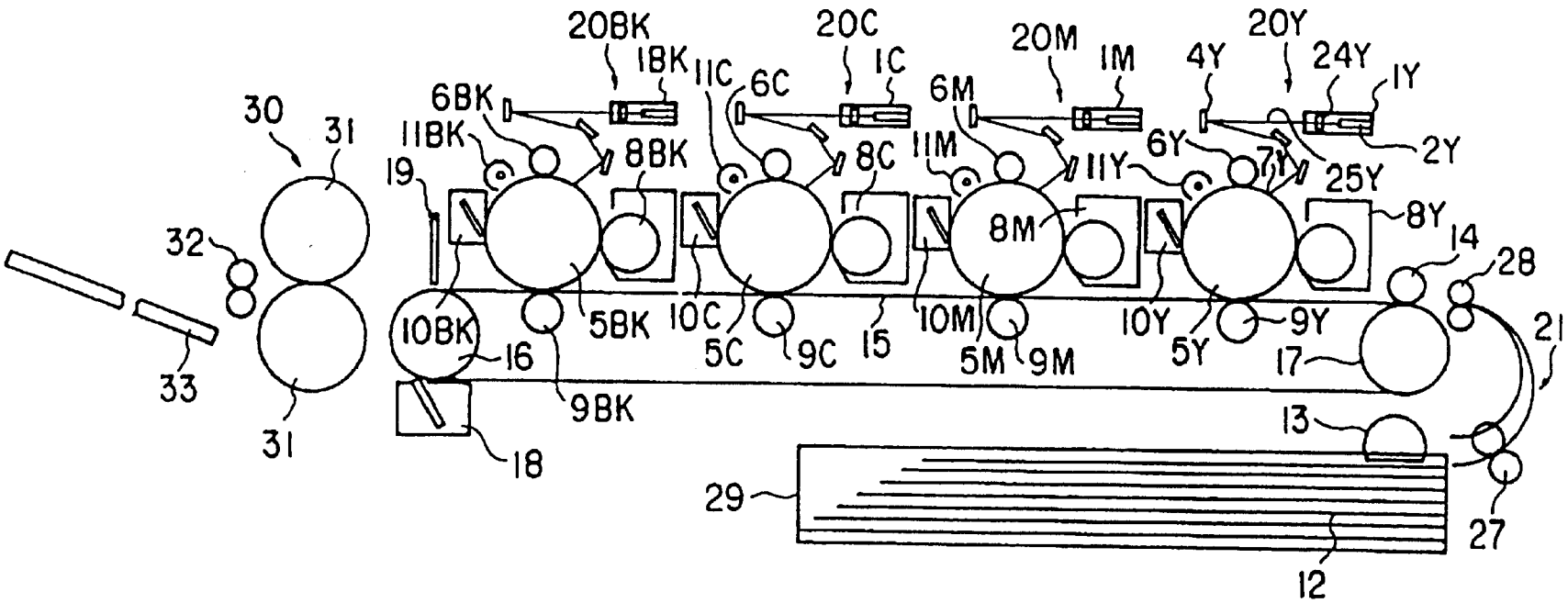

FIG. 1 shows a whole structure of a color copier as an image forming apparatus. In this color copier, as four image carriers arranged in parallel with each other sequentially, photosensitive drums 5Y, 5M, 5C and 5BK are arranged. In response to these photosensitive drums 5Y, 5M, 5C and 5BK, arranged are a yellow image forming unit 20Y, a magenta image forming unit 20M, a cyan image forming unit 20C and a black image forming unit 20BK. These image forming units 20Y, 20M, 20C and 20BK from respectively yellow, magenta, cyan and black images on the respective photosensitive drums 5Y, 5M, 5C and 5BK. And a conveyor unit 21 is arranged that conveys image receiving media to the photosensitive drums 5Y, 5M, 5C and 5BK. And further, transfer rollers 9Y, 9M, 9C and 9BK that transfer respectively toner images on the photosensitive drums 5Y, 5M, 5C and 5BK onto image receiving medium 12 that is conveyed by the transfer unit 21 so as to face the photosensitive drums 5Y, 5M, 5C and 5BK respectively.

Image forming units 20Y, 20M, 20C and 20BK respectively comprise a recording portion in turn comprising laser used optical systems 1Y, 1M, 1C and 1BK, main chargers 6Y, 6M, 6C and 6BK, developing devices 8Y, 8M, 8C and 8BK, cleaners 10Y, 10M, 10C and 10BK, charge eliminators 11Y, 11M, 11C and 11BK.

Now as an example, a yellow image forming unit 20Y is explained in detail hereinafter.

In accordance with image data that is transmitted in from an external device or so, in conformity to printing signals that are sent from a printing control portion not illustrate herein, a semiconductor laser oscillator is driven, and a laser beam 25Y is output. This output beam light 25Y is reshaped by a beam reshaping optical system that comprises, for example, a cylindrical lens and so forth. This reshaped beam light 25Y is polarized by a polygon mirror 2Y that is rotated by a high speed rotating motor.

The polarized beam light 25Y is reflected by a reflecting mirror 4Y via an fθ lens 24Y, and a light spot is formed with necessary resolution on an exposing position 7Y on the photosensitive drum 5Y. The light spot is scanned and exposed by rotation of the polygon mirror 2Y and the photosensitive drum 5Y. By this scanning and exposure, electrostatic latent image is formed on the photosensitive drum 5Y. And the polarized beam light 25Y is detected by a beam detector comprising a photo diode, and synchronization is made in the main scanning direction (horizontal direction).

Around the photosensitive drum 5Y, arranged are a main charger 6Y that charges the surface of the photosensitive drum 5Y, a laser used optical system 1Y, a developing device 8Y, a transfer roller 9Y, a cleaner 10Y, and a charge eliminator 11Y.

The photosensitive drum 5Y is rotated at external circumferential speed $V_0$ by a driving motor (not illustrated herein). The surface of the photosensitive drum 5Y is charged by the main charger 6Y comprising a charging roller having electric conductivity arranged to the surface of the photosensitive drum 5Y. The main charger 6Y is rotated by contacting the surface of the photosensitive drum 5Y.

The surface of the photosensitive drum 5Y is formed by an organic system photo-conductive material. This photo-conductive material is normally of high resistance, but when light is radiated, the specific resistance of light radiated portion changes. Therefore, when light corresponding to a yellow printing pattern is radiated from the laser used optical system 1Y onto the surface of the charged photosensitive drum 5Y, an electrostatic latent image of the yellow printing pattern is formed on the surface of the photosensitive drum 5Y.

An electrostatic latent image is an image that is formed on the surface of the photosensitive drum 5Y by charging. By light radiation from the laser used optical system 1Y, the specific resistance of the radiated surface of the photo-conductive material goes down, and charged electric charge flows on the surface of the photosensitive drum 5Y. Electric charge at the portion where light from the laser used optical system 1Y was not radiated remains. This remaining electric charge formed what is called a negative electrostatic latent image.

On the exposing position 7Y on the photosensitive drum 5Y charged in this manner, the laser beam 25Y of the laser used optical system 1Y is focused, and the photosensitive drum 5Y wherein a negative electrostatic latent image is formed rotates to the developing position at the speed $V_0$. And at this developing position, the negative electrostatic latent image on the photosensitive drum 5Y is formed into a toner image by the developing device 8Y.

In the developing device 8, contained is a yellow toner that is formed of resin so as to contain yellow dyeing agent. The yellow toner, when friction charged by being stirred in the developing device 8Y, has electric charge of the same polarity as electric charge charged on the photosensitive drum 5Y. As the surface of the photosensitive drum 5Y passes the developing device 8Y, yellow toner statically attaches to only latent image portion wherein electric charge is removed. By this toner attachment, the latent image is developed by yellow toner (reverse developing).

The photosensitive drum 5Y on which the yellow toner image has been formed rotates then at external circumferential speed $V_0$, and the yellow toner image is transferred onto the image receiving medium 12 that are conveyed by the conveyor unit 21 and the conveyor belt 15 by working of the transfer roller 9Y.

A paper supply system comprises a pick-up roller 13, a feed roller 27, and an aligning roller 28.

Only one sheet of the image receiving medium 12 pulled out from the paper supply cassette 29 by the pick-up roller 13 is conveyed to the aligning roller 28 by the feed roller 27. The aligning roller 28 corrects the posture of the image receiving medium 12, and then sends it to an adsorbing roller 14 on the conveyor belt 15. The rotational speed of the aligning roller 28 and the moving speed of the conveyor belt 15 are so set as to be equal to the circumferential speed $V_0$ of the photosensitive drum 5Y. The image receiving medium 12, with part thereof kept by the aligning roller 28, is conveyed to between the adsorbing roller 14 and the conveyor belt 15, where electric field is given, and the image receiving medium 12 is statically adsorbed onto the conveyor belt 15. The image receiving medium 12 statically adsorbed onto the conveyor belt 15 is sent to the transfer position of the photosensitive drum 5Y at the speed $V_0$ same as the speed of the photosensitive drum 5Y.

At the transfer position, the yellow toner image on the photosensitive drum 5Y contacting the image receiving medium 12 is transferred from the photosensitive drum 5Y to the image receiving medium 12 by the transfer roller 9Y. As a result, a yellow toner image of printing pattern based on yellow printing signal is formed on the image receiving medium 12.

The transfer roller 9Y comprises a transfer roller having conductivity. The transfer roller 9Y, from the back side of the conveyor belt 15, supplies electric field having opposite polarity to the electric potential of the yellow toner that statically attaches onto the photosensitive drum 5Y to the image receiving medium 12. This electric field works via the conveyor belt 15 and the image receiving medium 12 onto the yellow toner image on the photosensitive drum 5Y, and transfers the toner image from the photosensitive drum 5Y to the image receiving medium 12.

In this manner, the image receiving medium 12 to which the yellow toner image has been transferred is carried to the magenta image forming unit 20M, and further to the cyan image forming unit 20C, and then to the black image forming unit 20 BK.

By the way, the magenta image forming unit 20M, the cyan image forming unit 20C, and the black image forming unit 20 BK respectively have the same components and actions as the above yellow image forming unit 20Y, except that yellow is replaced by magenta, cyan, and black in the above respective units. Accordingly, for economy of descriptions, explanations on these image forming units are omitted herein.

The image receiving medium 12 that has passed the yellow transfer position, the magenta transfer position, the cyan transfer position and the black transfer position and on which a multiple colored image has been formed is carried to a fixing device 30.

The fixing device 30 comprises a heat roller 31 wherein a heater is integrated. By heating the toner image that is only placed on the image receiving medium 12 by electric charge force by the heat roller 31, the multiple colored toner image is solved, and is permanently fixed onto the image receiving medium 12. The image receiving medium 12 after completion of fixation is discharged onto a receiving tray 33 by exit rollers 32.

On the other hand, the photosensitive drums 5Y, 5M, 5C and 5BK that have passed the transfer positions are rotated at the external circumferential speed $V_0$ as they are, and are cleaned of remaining toner and paper powder by the cleaners 10Y, 10M, 10C and 10BK. And further, the electric potential of charge eliminator lamps of charge eliminators 11Y, 11M, 11C and 11BK is made constant, and at necessity, a series of processes from main chargers 6Y, 6M, 6C and 6BK is taken once again.

The conveyor belt 15 that conveys the image receiving medium 12 has an endless structure, and is supported by the driving roller 16 and the driven roller 17 at the fixing device 30 side. The driving roller 16 is transmitted its driving force from a driving motor not illustrated herein, and as mentioned previously, it is driven so that the rotational speed $V_0$ of the photosensitive drums 5Y, 5M, 5C and 5BK should be equal to the moving speed $V_0$ of the conveyor belt 15.

The conveyor belt 15, after sending out the image receiving medium 12 to the fixing device 30, is cleaned of remaining toner and paper powder on the belt surface by a belt cleaner 18.

In the case of single color printing, an image is formed by an optional single color image forming unit among the above units. At this moment, other image forming units than one of the selected color do not make actions.

Figure 2:
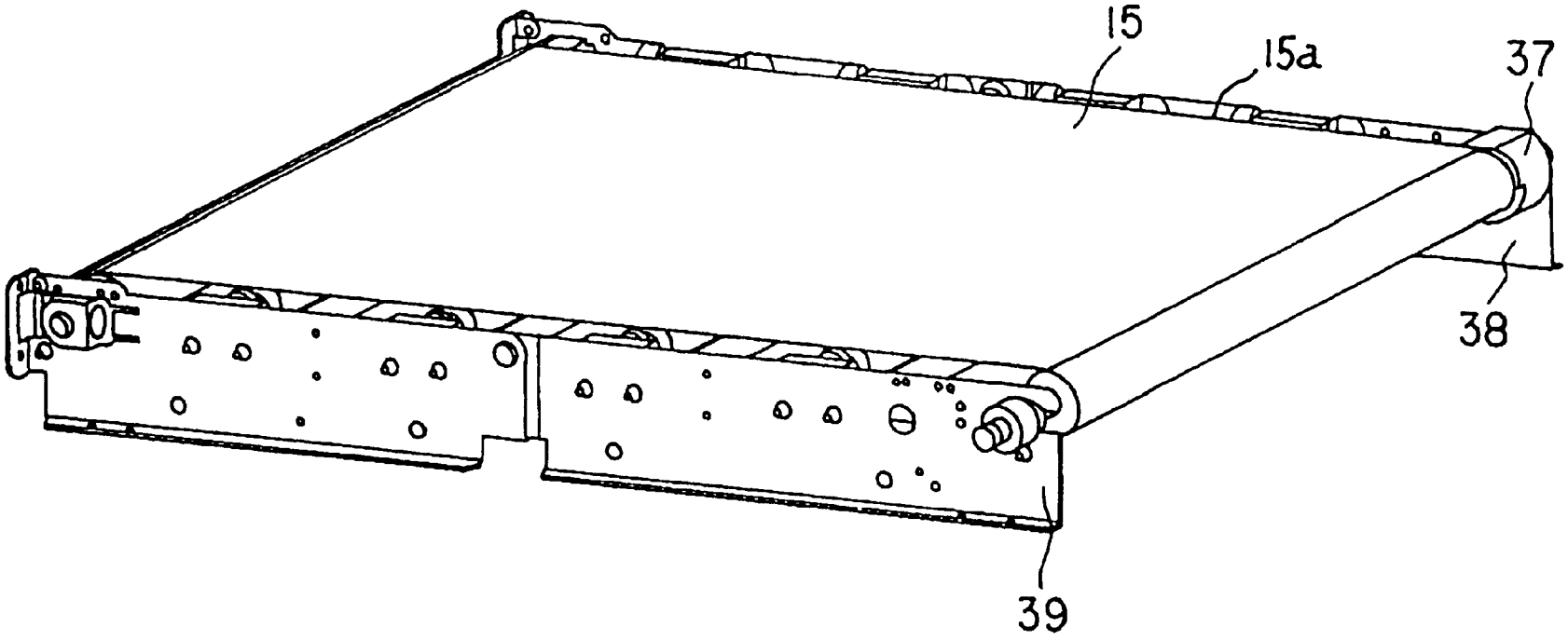
FIG. 2 is a perspective view showing a unit structure of a conveyor belt that is used in the color copier shown in FIG. 1, and is a first preferred embodiment according to the present invention.
Figure 3:
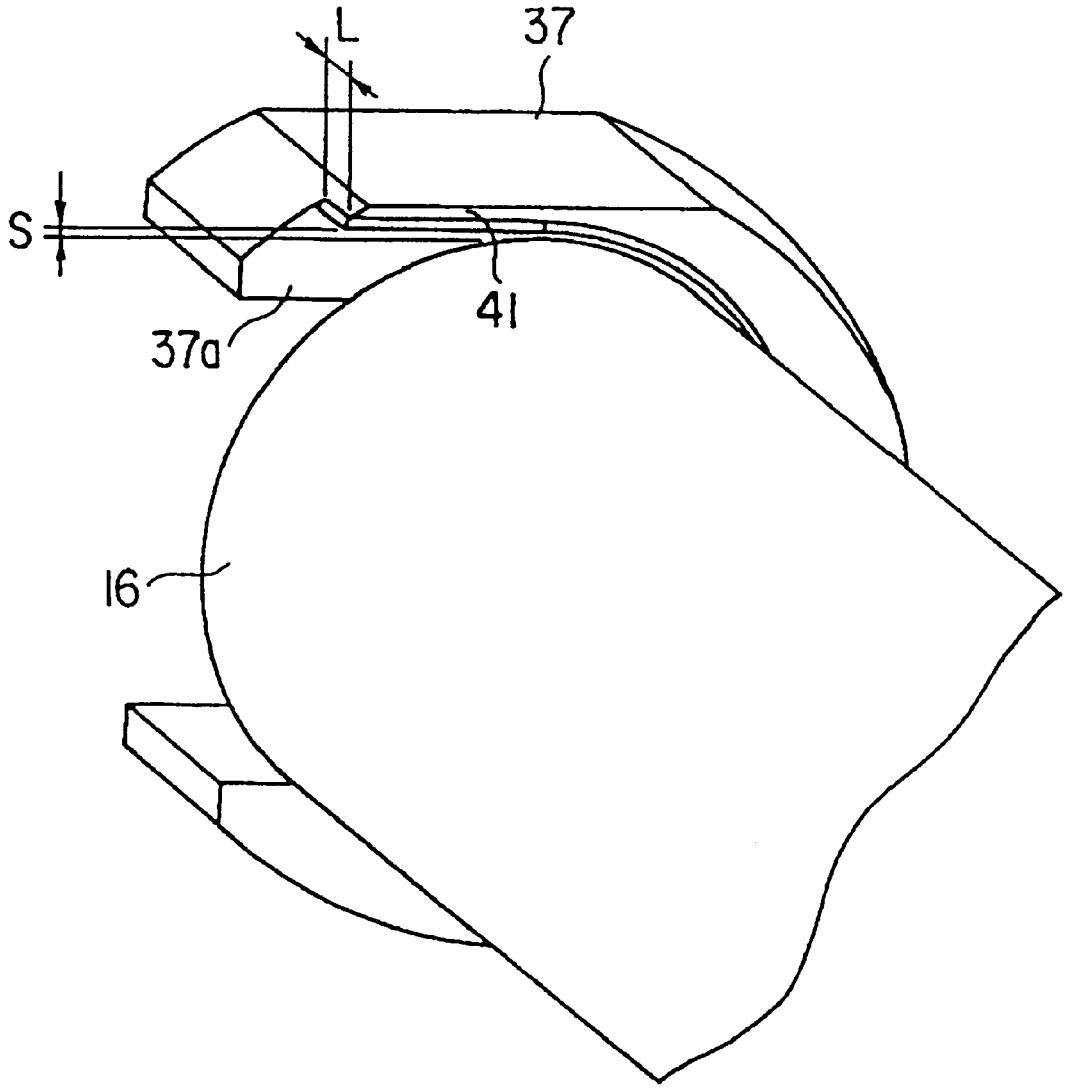
FIG. 3 is a perspective view showing a driving roller with a conveyor belt shown in FIG. 2, and a regulation plate that guides the movement of the conveyor belt.
Figure 4:
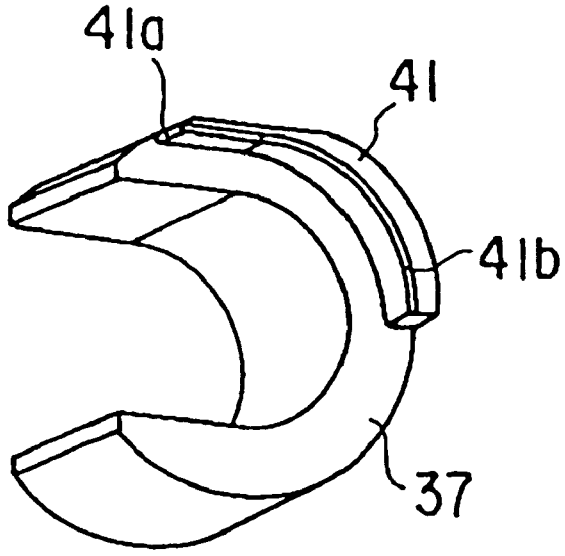
FIG. 4 is a perspective view showing the regulation plate shown in FIG. 3 viewed from other direction.
Figure 5:
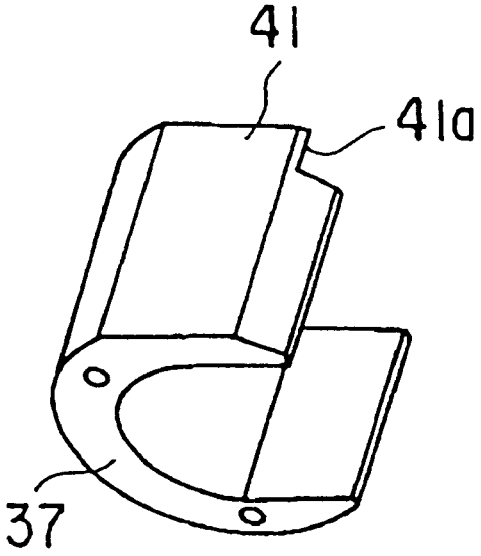
FIG. 5 is a perspective view showing the regulation plate shown in FIG. 3 viewed from still other direction.
Figure 6:
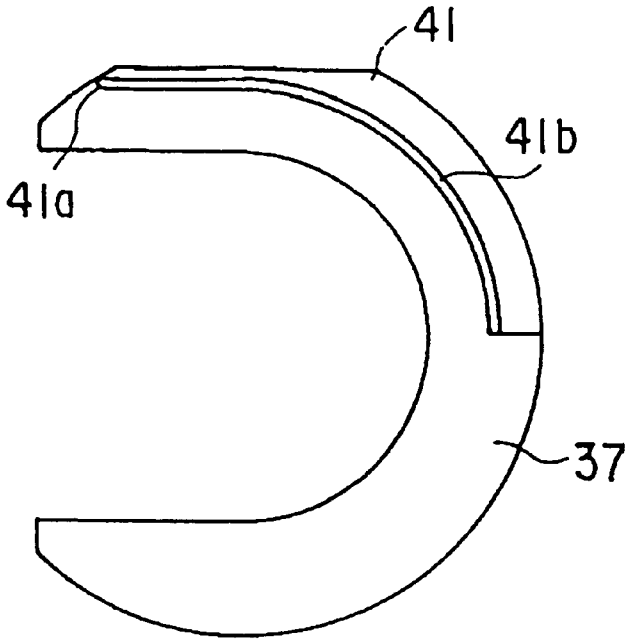
FIG. 6 is a side view showing the regulation plate shown in FIG. 5.
Figure 7:
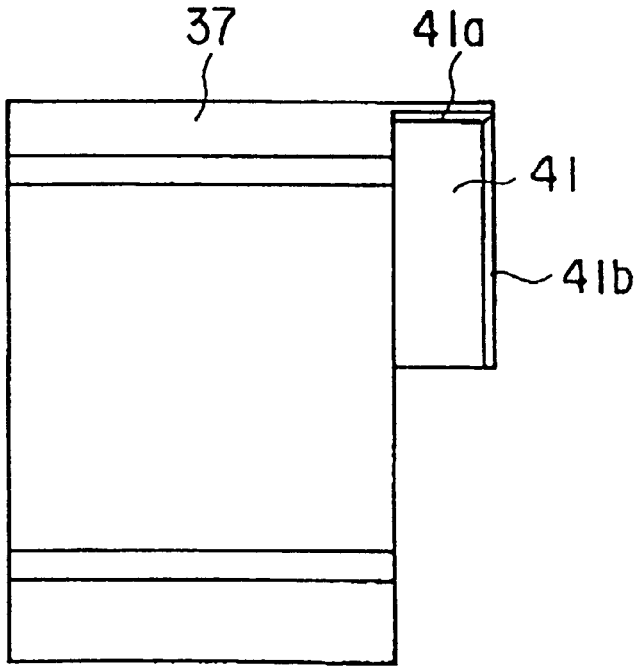
FIG. 7 is a frontal view showing the regulation plate shown in FIG. 6.

FIG. 2 is a perspective view showing the conveyor belt 15. At the front side of the driving roller 16 that makes the conveyor belt 15 run, arranged at the roller end surface is a regulation plate 37 in parallel with the moving direction of the conveyor belt 15. The regulation plate 37 is arrange din a status fixed to the front side frame 38 of the conveyor belt unit. The conveyor belt 15 has a structure to prevent the belt from snaking by making the belt end edge always sliding with the regulation plate 37.

In order for the regulation plate 37 and the end edge 15*a* of the conveyor belt 15 to always slide with each other, the front roller diameter of the driven roller 17 has a small taper structure, while the rear roller diameter has a large taper structure. Namely, when the front roller diameter of the driven roller 17 is set as d, while the rear roller diameter is set as D, there is a relation D>d. And if the rotational central axis of the driven roller 17 and that of the driving roller 16 are arranged in parallel, since the driven roller 17 is a driven roller, the surface facing the photosensitive drum 5 becomes a twisted plane. This is why the front side with a small roller diameter of the driven roller 17 as a tapered roller is arranged lifted from the horizontal line. This lift-up amount Z is determined by the equation Z=(D−d)/2. Namely, the difference for radius is obtained by making half the difference between the large diameter D and the small diameter d of the tapered roller (driven roller). Since the axis at the front side with a roller diameter is arranged lifted up by the difference for radius, the surface of the conveyor belt 15 facing the photosensitive belt 15 that is arranged between the driving roller 16 and the driven roller of the above tapered structure is kept in parallel.

By the arrangement of the tapered driven roller 17, the conveyor belt 15 that is run slides on the tapered surface from the large roller diameter of the rear side to the small roller diameter of the frontal side. Thereby, as explained previously, the regulation plate 37 arranged at the frontal frame 38 of the driving roller 16 and the end edge 15*a* of the conveyor belt 15 always slide with each other and run. Namely, the regulation plate 37 is arranged at the side of the small roller diameter of the driven roller 17. Accordingly, when to arrange the regulation plate 37 at the rear side of the small diameter of the driven roller 17, it is necessary to arrange the regulation plate 37 at the rear frame 39.

Lay force increases most at the point where the conveyor belt 15 and the regulation plate 37 slide and the conveyor belt 15 starts warping along the driven roller 16. When lay force concentrates upon this position, the conveyor belt 15 rises up in the direction to release reaction force received from the regulation plate 37.

Originally, it is ideal that the lay force of the conveyor belt 15 works vertically on the regulation plate 37, and force to push back the conveyor belt 37 vertically from the regulation plate 37 as the reaction force. However, when the lay force is large, the conveyor belt 15 is deformed and as a result it is apt to roll up. One of the reasons is that the conveyor belt 15 has an upward free degree to the regulation plate 37. Namely, since the conveyor belt 15 has special freedom in the direction to rise up, it rolls up.

Therefore, in the first preferred embodiment, the regulation plate 37 is structured as shown in FIG. 3 through FIG. 7, thereby it is possible to prevent the conveyor belt 15 from rolling up.

Namely, the regulation plate 37 has a sliding surface 37*a* as a first regulation surface that makes the end edge 15*a* of the conveyor belt 15 contact in horizontal direction and slide on. On the top side of the sliding surface 37*a*, integrally formed in arc shape is a projection 41 as a second regulation surface that regulates rolling up, i.e., movement in vertical direction of the conveyor belt 15. The projection 41 of the regulation plate 37 faces apart along the external circumferential surface of the driving roller 16, and the projection length is L, while the distance from the external circumferential surface of the driving roller 16 is S.

When the conveyor belt 15 is going to roll up along the sliding surface 37*a* of the regulation plate 37 under the lay force, it contacts the projection 41 and receives reaction force in the vertical direction to lay force, and rolling up is prevented.

And since it is possible to regulate the rolling up of the conveyor belt 15, it is also possible to prevent the breakage of rolling up root portion by bending fatigue from the cause of rolling up of the conveyor belt 15.

TABLE 1

| | | T (mm), L (mm) | | | | | | | | | | | | | | | | |
|---|---|---|---|---|---|---|---|---|---|---|---|---|---|---|---|---|---|---|
| T | L | 1.0 | 1.2 | 1.4 | 1.6 | 1.8 | 2.0 | 2.2 | 2.4 | 2.6 | 2.8 | 3.0 | 3.2 | 3.4 | 3.6 | 3.8 | 4.0 | 4.2 |
| 0.06 | | X | X | ○ | ○ | | | | | | | | | | | | | |
| 0.08 | | X | X | X | X | ○ | ○ | | | | | | | | | | | |
| 0.10 | | X | X | X | X | X | X | ○ | ○ | | | | | | | | | |
| 0.12 | | X | X | X | X | X | X | X | ○ | ○ | | | | | | | | |
| 0.14 | | X | X | X | X | X | X | X | X | X | X | ○ | ○ | | | | | |
| 0.16 | | X | X | X | X | X | X | X | X | X | X | X | X | ○ | ○ | | | |
| 0.16 | | X | X | X | X | X | X | X | X | X | X | X | X | X | ○ | ○ | | |
| 0.20 | | X | X | X | X | X | X | X | X | X | X | X | X | X | X | X | X | ○ |

TABLE 1 shows the results of an experiment with parameters wherein the conveyor belt has a practical upper limit Young's modulus $7\times10^4$ kg/cm$^2$ in the regulation plate method under the present invention, and the thickness T of practical conveyor belt is 0.06 mm–0.20 mm.

In this experiment, the lay force was set to the practical lower limit 0.1 kg, and the length L of the projection 41 of the regulation plate 37 was set 1.4 mm, and the conveyor belt 15 was run. And when the distance S from the external circumferential surface of the driving roller 16 to the projection 41 of the regulation plate 37 was changed, the presence of breakage of the conveyor belt 15 owing to rolling up was checked up to running 120,000 turns as the exchange standard of the conveyor belt 15.

When the conveyor belt 15 was not damaged up to running 120,000 turns as the exchange standard of the conveyor belt 15, the mark ○ was added, while the case when the conveyor belt was damaged before that was marked with ×.

As the distance S from the external circumferential surface of the driving roller 16 to the projection 41 of the regulation plate 37 becomes large, the conveyor belt 15 will roll up accordingly.

The experiment was carried out per belt thickness, and when specifications were achieved, for confirmation, experiment was carried out with a one step larger distance S.

As a result, to the practical lower limit lay force 0.1 kg at the practical upper limit Young's modulus $7\times10^4$ kg/cm$^2$ according to the regulation plate method, the following relation stands:

$$S\ \text{mm} < 15T\ \text{mm}$$

This relation equation is carried out by the conveyor belt of the practical upper limit Young's modulus and the practical lower limit lay force, so it is effective for both a conveyor belt with Young's modulus lower than the above and a conveyor belt with Young's modulus higher than the above.

For example, in the case of a conveyor belt with Young's modulus lower than the above, rolling up is apt to occur, therefore it is necessary to make the distance S small. And in the case of large lay force, rolling up is apt to occur too, therefore it is necessary to make the distance S small.

Accordingly, the above relation equation has a meaning to regulate the upper limits of the distance S and the belt thickness T, and shows all the relations.

TABLE 2

| | | T (mm), S (mm) | | | | | | | | | | | | | |
|---|---|---|---|---|---|---|---|---|---|---|---|---|---|---|---|
| T | S | 0.4 | 0.6 | 0.8 | 1.0 | 1.2 | 1.4 | 1.6 | 1.8 | 2.0 | 2.2 | 2.4 | 2.6 | 2.8 | 3.0 |
| 0.06 | | ○ | ○ | ○ | X | X | | | | | | | | | |
| 0.08 | | ○ | ○ | ○ | ○ | X | X | | | | | | | | |
| 0.10 | | ○ | ○ | ○ | ○ | ○ | ○ | X | X | | | | | | |
| 0.12 | | ○ | ○ | ○ | ○ | ○ | ○ | ○ | ○ | X | X | | | | |
| 0.14 | | ○ | ○ | ○ | ○ | ○ | ○ | ○ | ○ | ○ | ○ | X | X | | |
| 0.16 | | ○ | ○ | ○ | ○ | ○ | ○ | ○ | ○ | ○ | ○ | X | X | | |
| 0.18 | | ○ | ○ | ○ | ○ | ○ | ○ | ○ | ○ | ○ | ○ | ○ | ○ | X | X |
| 0.20 | | ○ | ○ | ○ | ○ | ○ | ○ | ○ | ○ | ○ | ○ | ○ | ○ | ○ | X |

TABLE 2 shows the results of the experiment to investigate the influence of the distance S of the regulation plate 37 with parameters wherein the conveyor belt has a practical upper limit Young's modulus $7\times10^4$ kg/cm$^2$ in the regulation plate method under the present invention, and the thickness T of practical conveyor belt is 0.06 mm–0.20 mm.

In this experiment, the lay force was fixed uniformly to the practical lower limit 0.1 kg, and the distance of the projection 41 was fixed to the shortest distance corresponding to the belt thickness T obtained the foregoing experiment, and the conveyor belt 15 was run. And when the distance L from the sliding surface 37*a* of the regulation plate 37 to be projection end of the projection 41 was changed, the presence of breakage of the conveyor belt 15 owing to rolling up was checked up to running 120,000 turns as the exchange standard of the conveyor belt 15.

When the conveyor belt 15 was not damaged up to running 120,000 turns as the exchange standard, the mark ○ was added, while the case when the conveyor belt was damaged before that was marked with X.

When the distance L to the projection end of the projection 51 becomes small, it is possible for rolling up to occur out of the projection 41, and the conveyor belt 15 will roll up accordingly.

The experiment was carried out per belt thickness, and when specifications were achieved, for confirmation, experiment was carried out with a one step larger distance S.

As a result, to the practical lower limit layer force 0.1 kg at the practical upper limit Young's modulus $7\times10^4$ kg/cm$^2$ according to the regulation plate method, the following relation stands:

$$L\ \text{mm} < 20T\ \text{mm}$$

This relation equation is carried out by the conveyor belt of the practical upper limit Young's modulus and the practical lower limit lay force, so it is effective for both a conveyor belt with Young's modulus lower than the above and a conveyor belt with Young's modulus higher than the above.

For example, in the case of a conveyor belt with Young's modulus lower than the above, rolling up is apt to occur, therefore it is necessary to make the projection length L of the projection 41 large.

And in the case of large lay force, rolling up is apt to occur too, therefore it is necessary to make the projection length L of the projection 41 large.

Accordingly, the above relation equation has a meaning to regulate the lower limits of the projection length L of the projection 41 of the regulation plate 37 and the belt thickness T, and shows all the relations.

FIG. 4 through FIG. 7 respectively shows the regulation plate 37.

The conveyor belt 15 may move in the range between of the distance S (FIG. 3) the projection 41 of the regulation plate 37 and the driving roller 16. When this action occurs, the end portion of the belt guiding side of the projection 41 and the surface of the conveyor belt 15 slide with each other, and the surface of the conveyor belt 15 may be damaged.

To prevent this damage, the end portion of the belt guiding side of the projection 41 is chamfered to form an arc portion 41*a* so that the conveyor belt 15 should not be damaged by the end portion of the projection 41 of the regulation plate 37.

An in the same way, the conveyor belt 15 and the end portion of the projected direction of the projection 41 may slide with each other. In this case too, the surface of the conveyor belt 15 may be damaged. To prevent this damage, the end portion of the projected direction of the projection 41 is chamfered to form an arc portion 41*b* so that the conveyor belt 15 should not be damaged by the end portion of the projected direction of the projection 41.

Thus, the portions that may contact the surface of the conveyor belt 15 of the projection 41 of the regulation plate 37 are chamfered to form the arc portions 41*a* and 41*b*, therefore, it is possible to use the regulation plate 37 with the projection 41 without make unnecessary damage on the conveyor belt 15.

Further, by arrangement of the projection 41, it is possible to prevent the rolling up of the conveyor belt 15 without making large the belt regulation area of the regulation plate 37.

Figure 8:
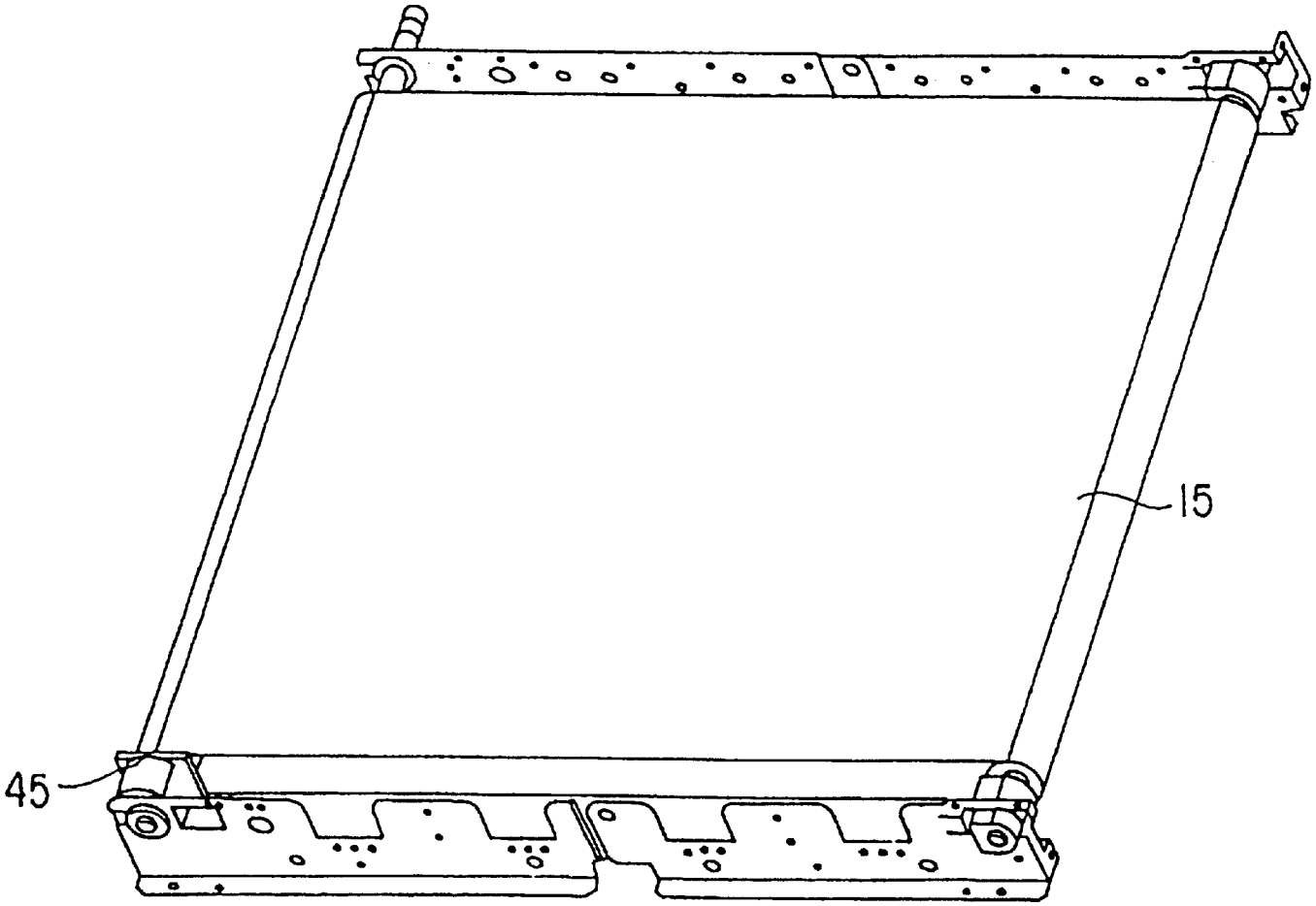
FIG. 8 is a perspective view showing a unit structure of a conveyor belt as a second preferred embodiment according to the present invention.

FIG. 8 is a perspective view showing a second preferred embodiment of the present invention.

In the second preferred embodiment, a glass regulation plate 45 of surface roughness 2 μm is employed.

A conveyor belt 15 was assembled with this, wherein the straightness of the sliding end edge 15*a* to the regulation plate 45 was 20, 30, 40, 50, 60, 70, 80, 90, 100, 110, 120, 130, 140, 150, 160, 170, 180, 190, and 200 μm, and an image was actually formed, and the formed image was evaluated by 20 general users.

When users minded color displacement of image, the mark X was made, while users did not minded color displacement of image, the mark ○ was added, and the resolution of the image was 600 DPI.

Figure 9:
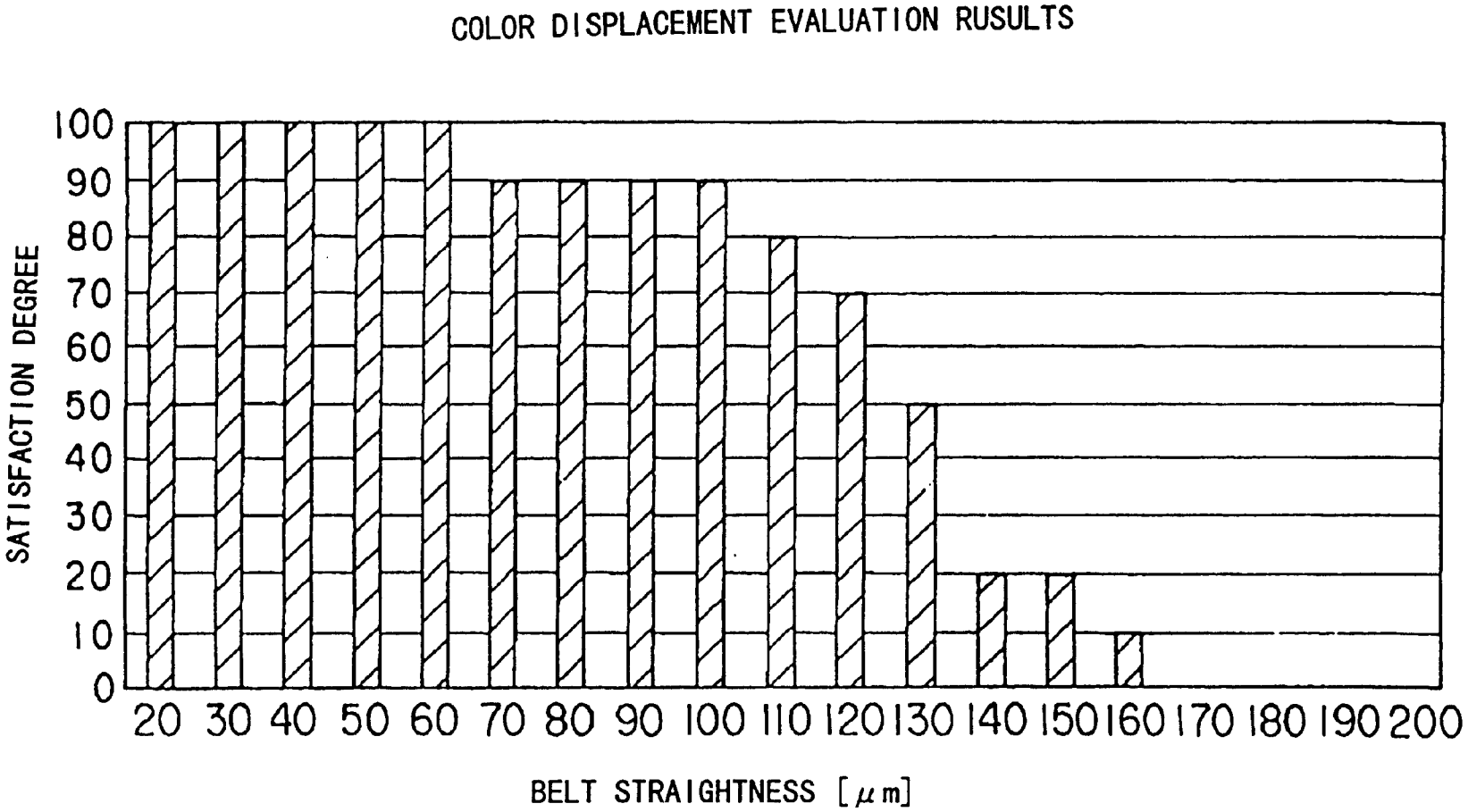
FIG. 9 is a graph showing the relation between straightness of a conveyor belt and color displacement.

FIG. 9 is a graph showing evaluation results wherein the case all the 20 users judged with the mark ○ was set 100%.

As a consequence, it is found that the condition that color displacement is not minded at other combination than the surface roughness 2 μm of the regulation plate 45 and straightness 100 μm of the conveyor belt 15 occupies more than 90%.

Namely, the color displacement amount caused by the snaking amount of the conveyor belt 15 becomes the total value of the surface roughness of the regulation plate 45 and the sliding end edge 15*a* of the conveyor belt 15. As for the numerical total value, the surface roughness 2 μm of the regulation plate 45 and straightness 100 μm of the conveyor belt 15 equals 102 μm.

Figure 10:
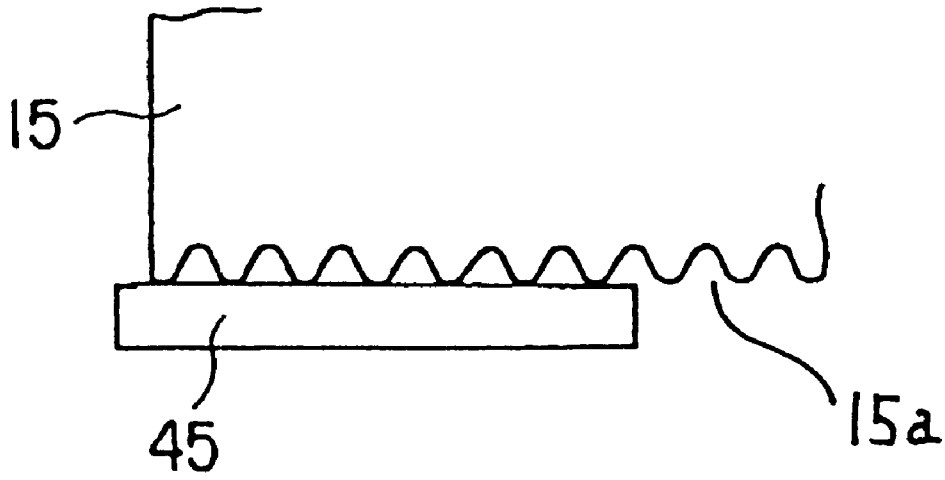
FIG. 10 is a top view showing the relation between a regulation plate and straightness of a conveyor belt.
Figure 11:
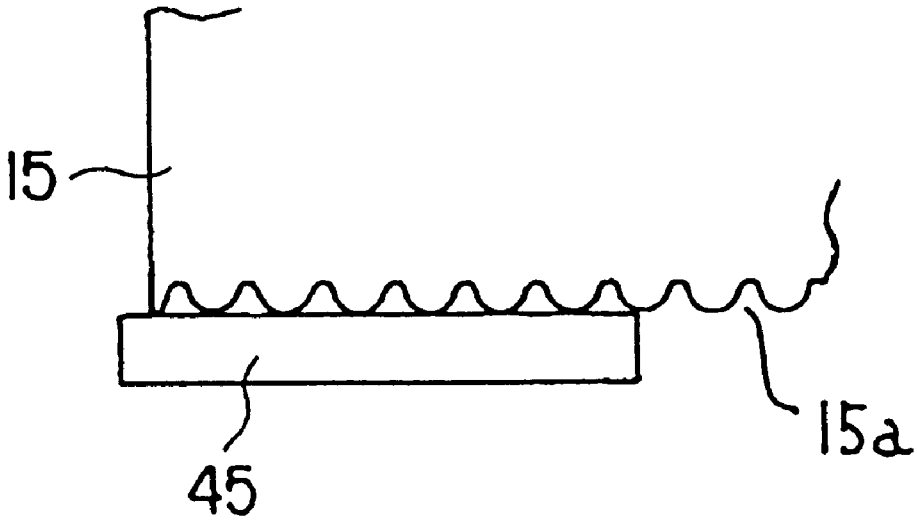
FIG. 11 is a top view showing the relation between a regulation plate and straightness of a conveyor belt.

However, as shown in FIG. 10, the conveyor belt 15 does not contact the regulation plate 45 at the most end portion of the sliding end edge 15*a* and keep lay force. Rather, as shown in FIG. 11, it is considered that the most end portion of the sliding end edge 15*a* of the conveyor belt 15 contacts the regulation plate 45 in a bit collapsed status and keeps lay force.

Parameters including the degree of collapsed status and the percentage of straightness of the conveyor belt 15 with respect to the snaking amount of the image generally cannot be regulated since it is considered that the parameters vary with the condition of straightness of the sliding end edge 15*a* of the conveyor belt 15.

However, the conveyor belt 15 becomes a bit collapsed status, the straightness 2 μm of the glass plate in this case may be considered to be allowable amount.

Therefore, the combination of straightness 100 μm of the sliding end edge 15*a* of the conveyor belt 15 and the surface roughness 2 μm of the regulation plate 37 was set as 100 μm.

As explained above, when the surface roughness of the regulation plate 45 is small, there is no problem in considering the straightness of the conveyor belt 15 as snaking amount.

As the result of the previous experiment, it was found that if color displacement amount (snaking amount of conveyor belt) was below 100 μm at resolution of 600 DPI, color displacement was almost negligible.

And as explained before, in the regulation plate method, the snaking amount of the conveyor belt 15 is below the total value of the straightness of the sliding end edge 15*a* of the conveyor belt 15 and the surface roughness of the regulation plate 37. Further, color displacement of image discussed is one a sheet of image, and the length in conveyance direction to discuss snaking amount is the maximum specification image receiving paper feed amount of device. Therefore, there is no need for the whole circumference of the conveyor belt 15 to have a target straightness. Namely, all it needs is to clear a target snaking amount (straightness of the sliding end edge 15*a* of the conveyor belt) in the length corresponding to the maximum specification image receiving paper feed amount of device.

And this snaking amount is expressed as the total value of the surface roughness of the regulation plate 45 and the sliding end edge 15*a* of the conveyor belt 15, so when it is possible to make small the surface roughness of the regulation plate 45, it is possible to make large the straightness of the sliding end edge 15*a* of the conveyor belt 15. On the contrary, when the surface roughness of the regulation plate 45 is large, it is necessary to make small the straightness of the sliding end edge 15*a* of the conveyor belt 15.

From the above discussion, it is necessary that in a color copier using the regulation plate method, the belt end edge 15*a* running along the sliding surface of the regulation plate 45 should be in 2 planes having distance 50 μm, between the most downstream sliding position of the regulation plate 45 as the most end to regulate the snaking of transfer belt and the length in the device maximum image receiving medium conveyance direction at the upstream side.

The present experiment shows the results with resolution 600 DPI, but the higher the resolution, the smaller the color displacement must become. Accordingly, the above definition may be adopted as it is as the upper limit value to images having resolution over 600 DPI.

Figure 12:
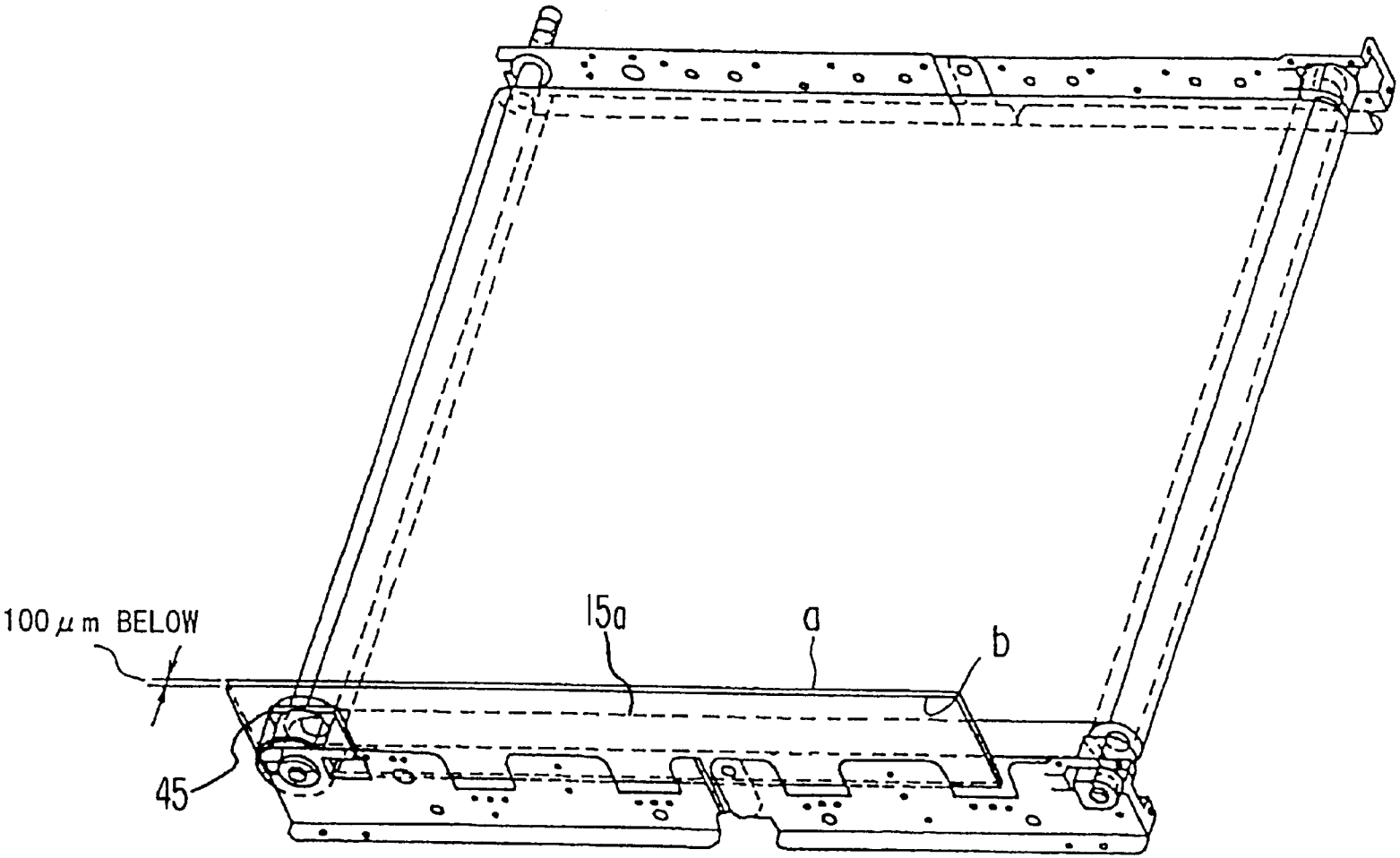
FIG. 12 is a perspective view schematically showing the position of the regulation surface of a regulation plate and the end edge of a conveyor belt.

FIG. 12 is a perspective view schematically showing the belt end edge 15*a* running along the sliding surface of the regulation plate 45 is on the two planes a and b having distance ±50 μm.

As explained previously, the snaking regulation of the conveyor belt 15 in the regulation plate method is realized by that the conveyor belt 15 is placed toward one side, and pressed by the regulation plate 37, and the regulation plate 37 is kept standstill and the end edge 15*a* of the conveyor belt 15 are slid and run.

The conveyor belt 15 is controlled so as to be placed toward the apparatus front side by balance of the driven roller 15 and impressed load. The conveyor belt 15 contacts the regulation plate 37, and thereby works lay force to the regulation plate 37.

Compressed stress works on the regulation plate 37 by this lay force, but if the regulation plate 37 is deformed by this compressed stress, the conveyor belt 15 is not kept standstill, and the conveyor belt 15 will snake though the end edge 15*a* of the conveyor belt 15 is slid and conveyed.

In order for the regulation plate 37 not to be deformed by compressed stress, it is first necessary that the modulus of longitudinal elasticity of the regulation plate 37 in regulation direction is larger than the modulus of the conveyor belt 15 in wide direction. When the modulus of longitudinal elasticity of the regulation plate 37 in regulation direction is smaller than the modulus of longitudinal elasticity the conveyor belt 15 in wide direction, the regulation plate 37 will be easily deformed by lay force of the conveyor belt 15. Namely, it is first required that the modulus of longitudinal elasticity of the regulation plate 37 in regulation direction is larger than the modulus of longitudinal elasticity of the conveyor belt 15 in wide direction. Secondly, in order to make the deformation of the regulation plate 37 in regulation direction that occurs by lay force a degree not to affect upon color displacement, it is necessary that the modulus of longitudinal elasticity of the regulation plate 37 in regulation direction should be over a specific size. The modulus of longitudinal elasticity (Young's modulus) E is defined by the following equation.

$$E\ \mathrm{kg/mm^2} = (W\ \mathrm{kg} \times L\,\mathrm{mm})/(A\ \mathrm{mm^2} \times \lambda\ \mathrm{mm})$$

wherein, $E$: modulus of longitudinal load (Young's modulus)

$W$: impressed load $L$: length of one that gives impressed load $A$: area of surface that gives impressed load $\lambda$: deformation amount of elongation or contraction The upper limit of the impressed load (lay force) in the practical application using the regulation plate method is about 1.0 kg. The length L of one that gives impressed load in this case is the length in the direction where the lay force of the regulation plate 37 works, and its substantial upper limit is 20 mm. And the area A that give impressed load in this case is the area of the sliding surface of the regulation plate 37, and in this second preferred embodiment, length 30 mm with the conveyor belt of thickness 0.1 mm is used, therefore, it is 3 $mm^2$, and substantially this area is the minimum value.

Further, the deformation amount of elongation or contraction $\lambda$ is the amount at which the regulation plate 37 causes compressed contraction by lay force impressed by the conveyor belt 15, and the amount that does not affect upon color displacement is considered to be 0.001 mm, a substantially appropriate value.

And these values are put in the above equation:

$$\begin{aligned} E\ (\mathrm{kg/mm^2}) &= (1\ \mathrm{kg} \times 20\ \mathrm{mm})/(3\ \mathrm{mm^2} \times 0.001\ \mathrm{mm}) \\ &= 6666.6 \\ &\approx 6700 \end{aligned}$$

Namely it is seen that the modulus of longitudinal elasticity of the regulation plate 37 in regulation direction should be more than 6,700 $kg/mm^2$. On the other hand, EB normally should be more than 210 $kg/mm^2$.

In the same manner, the conveyor belt 15 is controlled so as to be placed toward the apparatus front side by balance of the driven roller 15 and impressed load. The conveyor belt 15 contacts the regulation plate 37, and thereby works lay force to the regulation plate 37. Compressed stress works on the regulation plate 37 by this lay force, but if the regulation plate keeping component is deformed by this compressed stress, the conveyor belt 15 is not kept standstill, and the conveyor belt 15 will snake though the end edge 15*a* of the conveyor belt 15 is slid and conveyed.

In order for the regulation plate keeping component that keeps the regulation plate 37 not to be deformed by compressed stress, it is first necessary that the modulus of longitudinal elasticity of the front side frame 38 as a regulation plate supporting member in regulation direction is larger than the modulus of the conveyor belt 15 in wide direction. When the modulus of longitudinal elasticity of the front side frame 38 in regulation direction is smaller than the modulus of longitudinal elasticity the conveyor belt 15 in wide direction, the front side frame 38 as the regulation plate supporting member will be easily deformed by lay force of the conveyor belt 15. Namely, it is first required that the modulus of longitudinal elasticity of the front side frame 38 in regulation direction is larger than the modulus of longitudinal elasticity of the conveyor belt 15 in wide direction.

When the modulus of longitudinal elasticity of the conveyor belt 15 in width direction is set as EB, and the modulus of longitudinal direction of the above regulation plate 37 in conveyor belt width direction is set as ES, the above relation is expressed as below:

$$\mathrm{ES\ (regulation\ plate)} > \mathrm{EB\ (conveyor\ belt)}$$

$$\mathrm{ES\ (regulation\ plate)} \geqq 6{,}700\ \mathrm{kg/mm^2}$$

Secondly, in order to make the deformation of the front side frame 38 in regulation direction that occurs by lay force a degree not to affect upon color displacement, it is necessary that the modulus of longitudinal elasticity of the front side frame 38 in regulation direction should be over a specific size.

When the regulation plate 37 is supposed as a rigid body, the lay force generated by the conveyor belt 15 is added as it is via the regulation plate 37 to the front side frame 38.

In order for the front side frame 38 not to be deformed by force by the regulation plate 37, required is raw material of the modulus of longitudinal elasticity same as or more than that of the regulation plate 37. Namely, also in the front side frame 38, the modulus of longitudinal elasticity in regulation direction should be over 6,700 $kg/mm^2$.

When the modulus of longitudinal elasticity of the conveyor belt 15 in width direction is set as EB, and the modulus of longitudinal direction of the front side frame 38 is conveyor belt width direction as set as EF, the above relation is expressed as below:

$$\mathrm{EF\ (front\ side\ frame)} > \mathrm{EB\ (conveyor\ belt)}$$

$$\mathrm{EF\ (front\ side\ frame)} \geqq 6{,}700\ \mathrm{kg/mm^2}$$

In the case wherein the regulation plate 37 and the front side frame 38 of respectively different raw materials are arranged, the above conditions must be satisfied at the same time.

When the modulus of longitudinal elasticity of the conveyor belt 15 in width direction is set as EB, and the modulus of longitudinal direction of the above regulation plate 37 in conveyor belt width direction is set as ES, and the modulus of longitudinal direction of the above front side frame 38 in conveyor belt width direction is set as EF, the above relation is expressed as below:

$$\mathrm{EF\ (front\ side\ frame)} \geqq \mathrm{ES\ (regulation\ plate)} > \mathrm{EB\ (conveyor\ belt)}$$

$$\mathrm{EF\ (front\ side\ frame)} \geqq 6{,}700\ \mathrm{kg/mm^2}$$

$$\mathrm{ES\ (regulation\ plate)} \geqq 6{,}700\ \mathrm{kg/mm^2}$$

Figure 13:
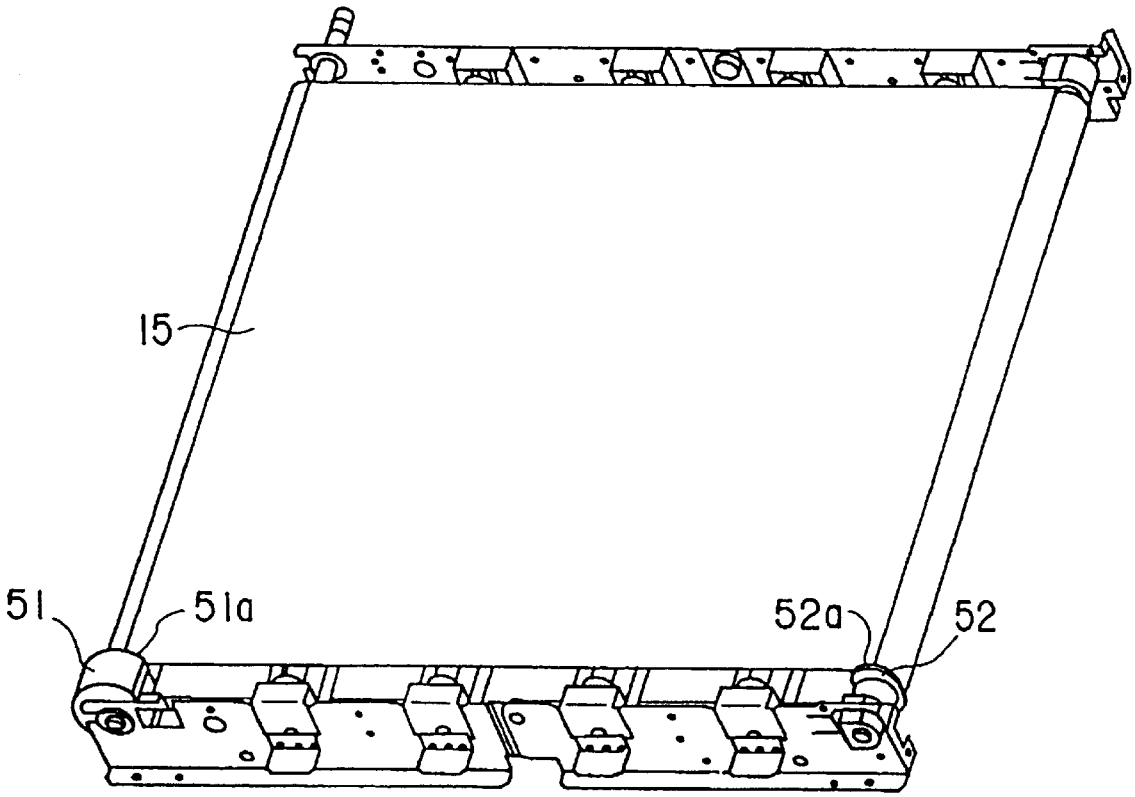
FIG. 13 is a perspective view showing a unit structure of a conveyor belt as a third preferred embodiment according to the present invention.
Figure 14:
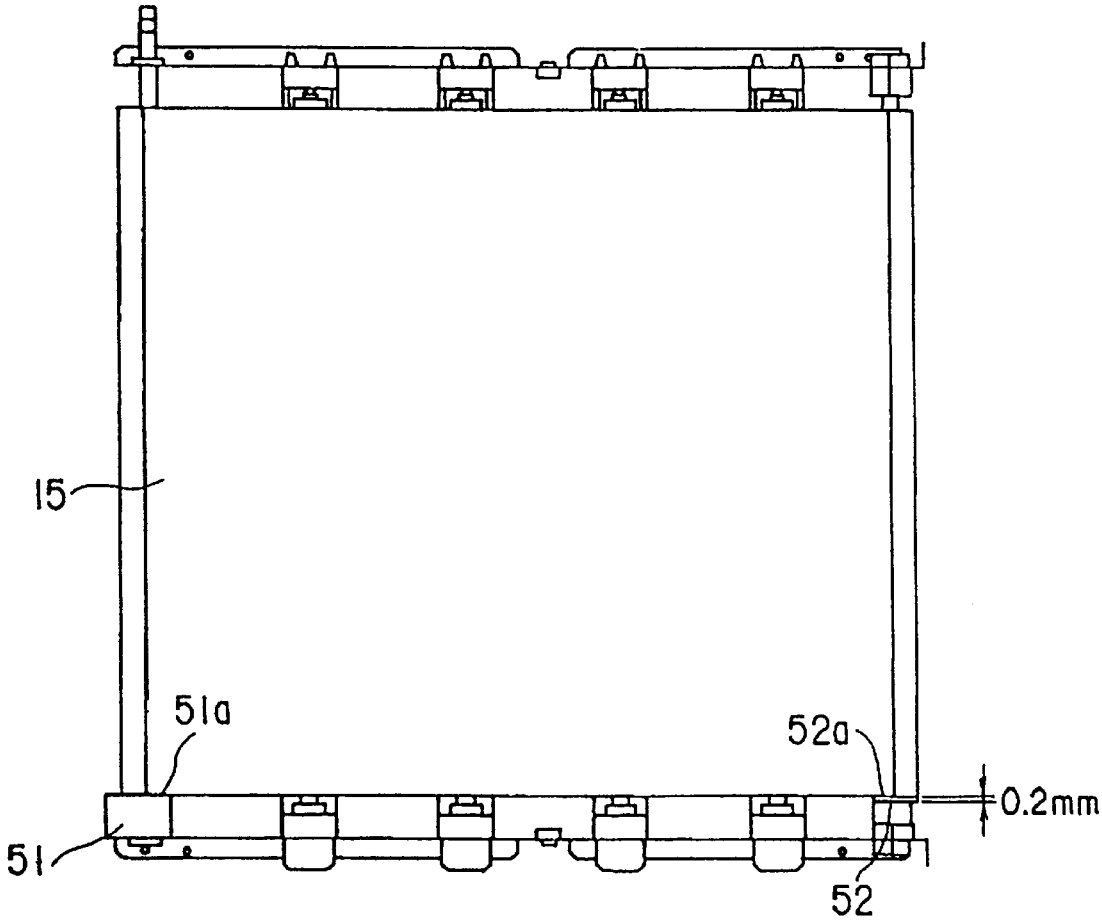
FIG. 14 is a plane view showing a unit structure of a conveyor belt.

FIG. 13 and FIG. 14 show a third preferred embodiment of the present invention.

The main regulation plate 51 as a first regulation means is arranged in parallel at one end surface of the driving roller 16. The main regulating plate 51, sliding with end edge 15*a* of the conveyor belt 15, prevents the conveyor belt 15 from snaking, and prevent color displacement from occurring from snaking of the conveyor belt 15.

Figure 15:
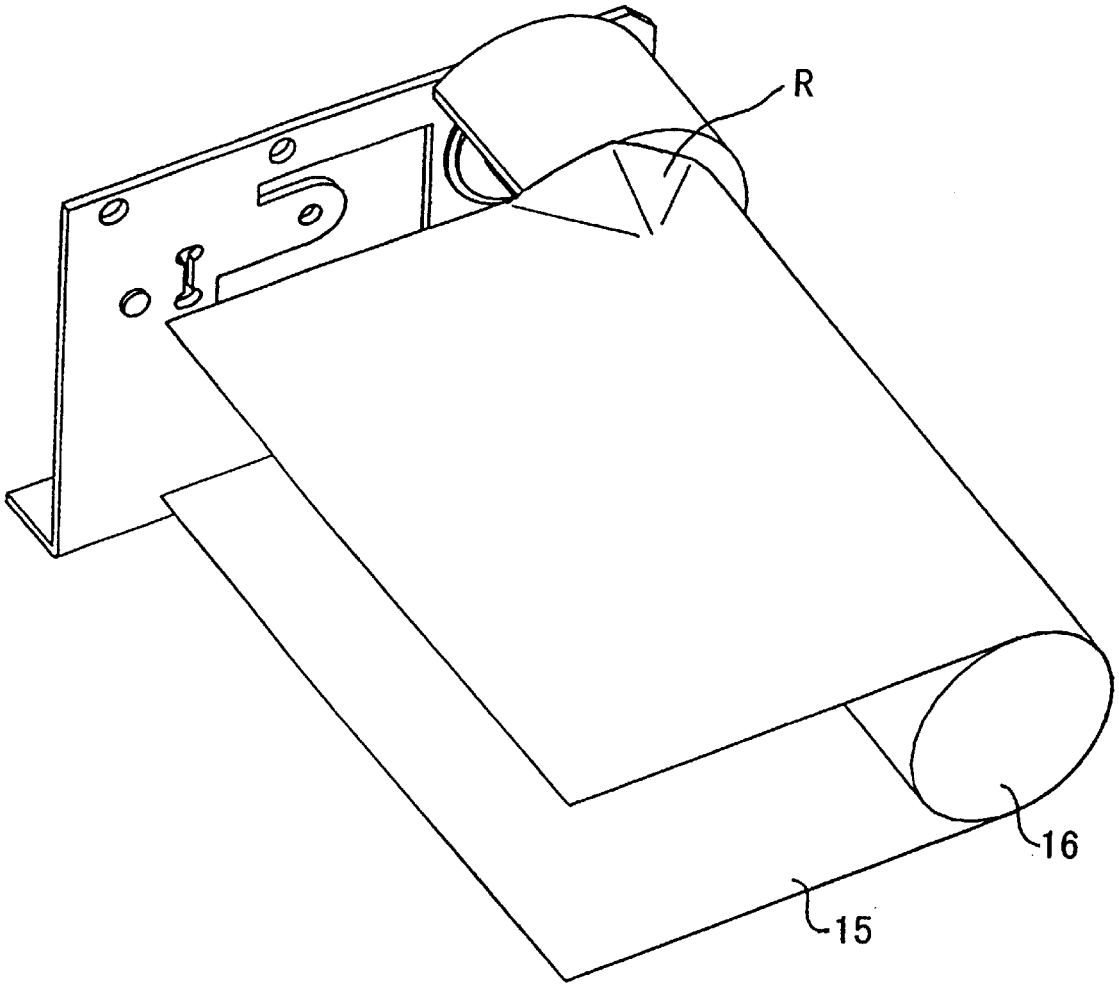
FIG. 15 is a perspective view showing a conveyor belt rolling up and bending fatigue occurs at the root of the rolling up portion.

However, when lay force continues being over the design value owing to external disturbance and so forth, the total lay force works on the main regulation plate 51 and the conveyor belt 15 rolls up, and bending fatigue occurs at the root of rolling up R as shown in FIG. 15, and the conveyor belt 15 may be broken.

As countermeasures against this, the sub regulation plate 52 as a second regulating plate is arranged in parallel at one end of the driven roller 17. The sliding surface 52*a* of the sub regulation plate 52 is arranged a bit outward to the conveyor belt 15 than the sliding surface 51*a* of the main regulation plate 51.

When the lay force becomes the design value owing to external disturbance and so forth, the conveyor belt 15 at the sub regulation plate 52 side moves largely to the regulation plate side. Thereby, the lay force working on the main regulation plate 51 increases.

The sub regulation plate 52, which is arranged a bit outward to the conveyor belt 15 than the main regulation plate 51, normally does not slide with the end edge 15*a* of the conveyor belt 15. At a large lay force, the conveyor belt 15 moves larger to the regulation plate side at the driven roller 17 side than design status, and at this moment, the sub regulation plate 52 slides with the conveyor belt 15 at the driven roller 17 side for the first time.

By sliding of the conveyor belt 15 by the sub regulation plate 52, the conveyor belt 15 cannot move toward the sub regulation plate side (driven roller side) any more. By this sub regulation plate 52, the conveyor belt 15, the conveyor belt 15 is regulated, and it is possible to control the snaking of the conveyor belt 15 without large force working on the main regulation plate 51 too.

And since large lay force does not work on the main regulation plate 51, the conveyor belt 15 will not roll up owing to lay force, accordingly there will be not breakage of the conveyor belt 15 by bending fatigue caused by rolling up.

By the way, in the third preferred embodiment, the sliding surface 52*a* of the sub regulation plate 52 is arranged 0.2 mm outward to the conveyor belt 15 than the sliding surface 51*a* of the main regulation plate 51.

As explained heretofore, according to the present invention, wherein a guide portion to regulate the rolling up of a conveyor means is arranged on a regulating means, the conveyor means cannot go over the regulating means. Therefore, it is possible to solve the problem of occupied area without making the regulating means large.

And by the arrangement of the guide portion, it is possible to prevent the conveyor means from rolling up on the sliding surface of the regulating means, as a result, there is not bending fatigue of the conveyor means owing to rolling up, and it is possible to prevent the conveyor means from being broken.

Further, the regulation surface of the regulating means, and the end edge 15*a* of the conveyor means that slides and runs on the regulation surface are arranged in a position in the distance ±50 $\mu$m, between the most downstream sliding portion of the regulating means and the upstream apparatus maximum image receiving medium conveyance direction length, as a result, it is possible to provide an image forming apparatus with little color displacement.

Moreover, when the modulus of longitudinal elasticity of the conveyor means is width direction is set as EB, and the modulus of longitudinal direction of the regulating means in conveyor means width direction is set as ES, the relation between the above EB and the above ES is set that ES (regulation plate)>EB (conveyor means), and raw material over 6,700 kg/mm$^2$ is used as ES, accordingly, the regulating means is not deformed by lay force of the conveyor means, and it is possible to provide a stable image forming apparatus with little color displacement.

Still further, when the modulus of longitudinal elasticity of the conveyor means in width direction is set as EB, and the modulus of longitudinal direction of the keeping means in conveyor means width direction is set as EF, the relation between the above EB and the above EF is set that EF (supporting member)>EB (conveyor means), and raw material over 6,700 kg/mm$^2$ is used as EF, accordingly, the regulating means is not deformed by lay force of the conveyor means, and it is possible to provide a stable image forming apparatus with little color displacement.

And, when the modulus of longitudinal elasticity of the conveyor means in width direction is set as EB, and the modulus of longitudinal direction of the regulating means in conveyor means width direction is set as ES, and the modulus of longitudinal direction of the supporting member in conveyor means width direction is set as EF, the relation among the above EB and the above ES and the above EF is that EF (supporting member)≧ES (regulating means)>EB (conveyor means), and raw material over 6,700 kg/mm$^2$ is used as ES and EF, as a result, both the regulating means and the supporting member is not deformed by lay force of the conveyor means, and it is possible to provide a stable image forming apparatus with little color displacement.

Still further, a second regulating means that has a second regulation surface outward of the conveyance means than a first regulation surface of a first regulating means is arranged, therefore, even if excessive lay force occurs at the conveyor means, it is possible to restrict this by the second regulating means, accordingly, it is possible to prevent breakage of the conveyor means owing to deformation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An image forming apparatus comprising:

plural image carriers arranged in parallel with each other at specified intervals;

plural developed image forming means for forming developed images on the plural image carriers;

conveyor means arranged between a driving roller and a driven roller and faces the plural image carriers for conveying an image receiving medium to the image carriers one after another;

plural transfer means for transferring the developed images formed on the image carriers onto the image receiving medium that are conveyed by the conveyor means; and regulating means arranged in parallel at the end of at least one of the driving roller and the driven roller, the regulating means including a first regulation surface that makes the end edge of the conveyor means contact and slide in horizontal direction when the conveyor means runs and regulates the snaking of the conveyor means and a second regulation surface that protrudes from the first regulation surface so as to regulate the movement of the end edge of the conveyor means in vertical direction.

2. An image forming apparatus set forth in claim 1, wherein when the distance from the external circumferential surface of the driving roller and the driven roller to the second regulation surface is set as S mm, and the thickness of the conveyor means is set as T mm, the following relation stands:

$$S\ mm<15T\ mm.$$

3. An image forming apparatus set forth in claim 1, wherein when the projection length of the second regulation surface is set as L mm, and the thickness of the conveyor means is set as T mm, the following relation stands:

$$L\ mm<20T\ mm.$$

4. An image forming apparatus set forth in claim 1, wherein an end portion of the conveyor means guiding side to the second regulation surface is chamfered.

5. An image forming apparatus set forth in claim 1, wherein an end portion of the projection direction side of the second regulation surface is chamfered.

6. An image forming apparatus comprising:

plural image carriers arranged in parallel with each other at specified intervals;

plural developed image forming means for forming developed images on the plural image carriers;

conveyor means arranged between a driving roller and a driven roller and faces the plural image carriers for conveying an image receiving medium to the image carriers one after another;

plural transfer means for transferring the developed images formed on the image carriers onto the image receiving medium that are conveyed by the conveyor means; and regulating means, that is arranged in parallel at the end of at least one of the driving roller and the driven roller and having a regulation surface, for regulating a snaking of the conveyor means by making the end edge of the conveyor means slide on the regulation surface when the conveyor means runs;

wherein when a modulus of longitudinal elasticity of the regulating means in width direction of the conveyor means is set ES and a modulus of longitudinal elasticity in width direction of the conveyor means is set EB, there is a relation between the ES and the EB as shown below, $$ES>EB$$

and the ES is a material over 6,700 kg/mm$^2$.

7. An image forming apparatus comprising:

plural image carriers arranged in parallel with each other at specified intervals;

plural developed image forming means for forming developed images on the plural image carriers;

conveyor means arranged between a driving roller and a driven roller and faces the plural image carriers for conveying an image receiving medium to the image carriers one after another;

plural transfer means for transferring the developed images formed on the image carriers onto the image receiving medium that are conveyed by the conveyor means; and regulating means, that is arranged in parallel at the end of at least one of the driving roller and the driven roller and having a regulation surface, for regulating a snaking of the conveyor means by making the end edge of the conveyor means slide on the regulation surface when the conveyor means runs; and supporting means for supporting the regulating means;

wherein when a modulus of longitudinal elasticity of the supporting means in width direction of the conveyor means is set EF, and a modulus of longitudinal elasticity in width direction of the conveyor means is set EB, there is a relation between the EF and the EB as shown below, $$EF>EB$$

and the EF is a material over 6,700 kg/mm$^2$.

8. An image forming apparatus comprising:

plural image carriers arranged in parallel with each other at specified intervals;

plural developed image forming means for forming developed images on the plural image carriers;

conveyor means arranged between a driving roller and a driven roller and faces the plural image carriers for conveying an image receiving medium to the image carriers one after another;

plural transfer means for transferring the developed images formed on the image carriers onto the image receiving medium that are conveyed by the conveyor means; and regulating means, that is arranged in parallel at the end of at least one of the driving roller and the driven roller and having a regulation surface, for regulating a snaking of the conveyor means by making the end edge of the conveyor means slide on the regulation surface when the conveyor means runs; and supporting means for supporting the regulating means;

wherein when a modulus of longitudinal elasticity of the supporting means in width direction of the conveyor means is set EF, a modulus of longitudinal elasticity in width direction of the conveyor means is set EB, and the modulus of longitudinal direction of the regulating means in conveyor means width direction is set as ES, there is a relation between the EF, EB and ES as shown below, $$EF \geqq ES>EB$$

and the EF and ES are made of a material over 6,700 kg/mm$^2$.

9. An image forming apparatus comprising:

plural image carriers arranged in parallel with each other at specified intervals;

plural developed image forming means for forming developed images on the plural image carriers;

conveyor means arranged between a driving roller and a driven roller and faces the plural image carriers for conveying an image receiving medium to the image carriers one after another;

plural transfer means for transferring the developed images formed on the image carriers onto the image receiving medium that are conveyed by the conveyor means;

first regulating means that is arranged in parallel at the end surface of the driving roller and having a first regulating surface, for regulating a snaking of the conveyor means by making the end edge of the conveyor means slide on the regulating surface when the conveyor means runs; and second regulating means that is arranged in parallel at the end surface of the driven roller and positioned at outer side in width direction than the first regulation surface and having a second regulation surface, for regulating a snaking of the conveyor means by making the end edge of the conveyor means slide on the second regulation surface when the conveyor means run.

* * * * *